United States Patent [19]

Chung

[11] 4,112,268

[45] Sep. 5, 1978

[54] DOUBLE SIDE AIR BREAK DISCONNECTING SWITCH

[75] Inventor: Asuncion Chung, Hoffman Estates, Ill.

[73] Assignee: H. K. Porter Company, Inc., Chicago, Ill.

[21] Appl. No.: 746,380

[22] Filed: Dec. 1, 1976

[51] Int. Cl.[2] ..... H01H 31/02

[52] U.S. Cl. ..... 200/48 SB

[58] Field of Search ..... 200/48 R, 48 A, 48 P, 200/48 V, 48 KB, 48 SB, 48 CB, 49

[56] References Cited

U.S. PATENT DOCUMENTS

| | | | |
|---|---|---|---|
| 1,792,282 | 2/1931 | Crabbs et al. | 200/48 A |
| 1,854,441 | 4/1932 | Alsaker et al. | 200/48 R |
| 2,132,686 | 10/1938 | Hampton | 200/48 R |
| 2,709,739 | 5/1955 | Gilliand et al. | 200/48 CB X |
| 3,052,786 | 9/1962 | Bertling | 200/48 SB X |

*Primary Examiner*—Stephen Marcus
*Attorney, Agent, or Firm*—Robert D. Yeager

[57] ABSTRACT

A double break air disconnecting switch for high voltage electric power installations having a switchblade fixed to a rotatable center insulator for unitary movement therewith and fixed jaw contacts mounted at the ends of the switchblade. A pivoting contact bar which is engaged by one of the jaw contacts is supported from each outside insulator stack. Each contact bar is pivotally supported from the associated insulator stack for movement between a closed position in high pressure engagement with the jaw contact and an open position not in high pressure engagement with the associated jaw contact. During closing as the contact bar pivots from the open position to the closed position, the contact bar pivots around its longitudinal axis with respect to the jaw contact from the low pressure engagement position to the high pressure engagement position. The contact bar is supported on a terminal assembly which also includes a pivot locking device for locking the contact bar in the open position until the associated jaw contacts are fully inserted around the contact bar. The jaw contact when properly disposed around the contact bar releases the pivot lock and permits the contact bar to pivot to the closed position. The pivotable portion of the terminal assembly also includes a hook portion which is engaged by a sleeve portion supported from the jaw contact for positive movement of the terminal assembly to the open position when the switchblade is moved to the open position. Contact through the terminal assembly is maintained by sliding or rotating contact surfaces and no flexible braid or cable is required. The jaw contact is of the reverse loop type. The reentrant portion of the contact jaws are biased together by the springs which are partially insulated from the contact surfaces. An insulating spacer is disposed between the free ends of the reentrant contact portions for maintaining uniform spacing therebetween. The pivot portion of the terminal contact is provided with stops to limit travel when moving to the open or closed positions.

28 Claims, 12 Drawing Figures

DOUBLE SIDE AIR BREAK DISCONNECTING SWITCH

BACKGROUND OF THE INVENTION

1. Field of the Invention

This invention relates to air break disconnecting switches and more particularly to a double side air break disconnecting switch wherein an elongated switchblade is connected to a rotatable center insulator for rotation therewith and has rigidly secured to its outer ends a jaw type contact which engages contact bars mounted on the outer insulators.

2. Description of the Prior Art

The most commonly used double side air break disconnect switch is a low profile, group operated, three insulator air break disconnecting switch, in which the center insulator is rotated to open and close the switch. U.S. Pat. Nos. 2,760,019; 3,134,865; and 3,836,737 are exemplary of various types of the most common horizontal double air break disconnecting switch. These patents illustrate various kinds of horizontal double break disconnecting switches wherein the jaw contacts are supported on stationary insulators and the switchblade is rotated about its longitudinal axis to make high pressure electrical contact between the blade jaw contacts.

In a conventional double side break air disconnect switch rotation of the center insulator rotates an elongated switchblade about its vertical axis, which is perpendicular to its longitudinal axis, into the jaw contacts. When the blade tips reach a stop inside of the jaw contacts, further rotation of the center insulator will cause the blade to roll over around its longitudinal axes to establish high pressure electrical contact.

One problem with this type of a prior art air break disconnect switch construction is that if the blade hits an obstacle, such as an ice buildup, before it has entered the jaw contacts, it will rotate about its longitudinal axis prematurely. Another problem is sometimes encountered if the switch is operated at a high speed, during the closing sequence the blade can prematurely rotate and come in flat, the fully closed position, against the jaw contacts. During fast closing, the switchblade can also bounce out of the jaw contacts and twist to a fully closed position outside the contact shoes. Little or no contact pressure can be established if these undesirable events occur. These events can sometimes occur, however, since the switchblade is not fully controlled at all times.

U.S. Pat. No. 1,792,282 to H. J. Crabbs et al. and U.S. Pat. No. 1,901,688 to A. Alsaker et al. illustrate air break disconnecting switches wherein a jaw contact is carried by a movable switchblade. The Crabbs et al. patent illustrates a single disconnect switch wherein the switchblade is rotated about its longitudinal axes to cause high pressure engagement with a stationary contact bar. The switchblade in Crabbs et al. when moving from a closed position is pivoted to disengage from the stationary contact and moves to a partially upright open position. In Alsaker et al. a horizontal side double break air disconnect switch is disclosed wherein all three insulating stacks are movable. The jaw contacts are positioned to engage a vertical contact bar. The center insulator stack is rotated to bring the jaw contacts supported on the ends of the switchblade around the vertical contact bars. The outside insulators which support the vertical contact bars are then rotated to cause high pressure engagement between the contact bars and the associated jaw contacts.

U.S. Pat. No. 2,306,117 to J. P. Dunlap shows an air break disconnect switch wherein a jaw type contact is supported for pivotal movement from a stationary insulator stack. FIGS. 8 and 9 of Dunlap show this concept as applied to a double break horizontal disconnecting switch. The jaw type contacts are supported from each end stationary insulator for movement in a horizontal plane. U.S. Pat. No. 2,707,732 to T. B. Ortwig shows another high voltage air disconnect switch wherein a jaw contact is pivotally supported from a stationary insulator.

U.S. Pat. No. 2,293,652 to T. F. Johnson illustrates a single break air disconnecting switch wherein a contact bar is supported for pivotal movement on a stationary insulator stack. During operation the double switchblade portions move generally along their longitudinal axis to engage the pivotable contact bar.

In constructing a double break disconnecting switch it is desirable if the switchblade is always fully controlled. It is also desirable that the switch be relatively simple, inexpensive, and easy to maintain. A further desirable feature for a competitive air break disconnect switch is that it be operable by a relatively low torque.

SUMMARY OF THE INVENTION

An air break disconnect switch is disclosed wherein the switchblade is fully controlled for unitary movement with the rotatable insulator from which it is supported. The switchblade does not twist or move about its longitudinal axis. Rotation of the rotatable supporting insulator is all that is required to operate the disclosed air break disconnecting switch. A jaw contact is mounted at the free end of the switchblade and this engages a contact bar which is supported from a stationary insulator. The contact bar is pivotally supported from the stationary insulator and is movable between a closed position in high pressure engagement with the contact jaw and an open position not in high pressure engagement with the contact jaw. Mechanical advantage is obtained for pivoting the contact bar from a pair of pivot support arms which support the contact bar at one end and which are pivoted around their other end on bearing surfaces fixed to the stationary insulator.

In one embodiment of the invention a double side air break disconnecting switch is taught wherein three vertical insulators are supported from an elongated base structural support member. The center insulator is rotatable about its longitudinal axis and the two end insulators are stationary. An elongated switchblade is securely fastened intermediate its ends to the top of the rotatable center insulator for unitary movement therewith. The elongated switchblade is securely fastened to the center insulator for no rotational movement abouts its longitudinal axis. A jaw type contact is supported on each end of the switchblade and is disposed to engage a horizontal contact bar. Associated with each jaw contact is a contact bar supported from each of the outer stationary insulators. Each contact bar is disposed horizontally. When the double side air break disconnect switch is closed, the jaw contacts engage the contact bars forming a continuous electrical path between terminal pads supported from the outer stationary insulators. Each terminal includes a pivot assembly which supports the contact bar. The contact bar is thus movable about the top of the stationary insulator. The contact bar is not pivoted around its end, rather elongated pivot arms are attached to the ends of the contact bar and these are pivoted around their ends opposite the contact bar. The contact bars can thus be moved between a closed position wherein they are in high pressure engagement with the bifurcated portion of the associated jaw contact and the open position wherein they are not in high pressure engagement with the associated jaw contact. The desired mechanical advantage can be achieved by proper construction of the elongated pivot arms. A lock or latch is provided for the pivot arms to lock the contact bar in the open position until the association jaw contact is fully inserted around the contact bar. When the associated jaw contact is fully inserted around the contact bar, the lock is released and the contact bar can move to the closed position. A sleeve member is provided on each jaw contact which engages a hook formed on one of the pivot arms as the switch is closed. The sleeve member can be fixed or made movable into the hook as the contact bar or terminal is engaged. When the switch is opened, the connected hook and sleeve move the pivot arms, which supports the contact bar, to the open position independent of the engagement between the jaw contact and the contact bar. This construction is substantially different from most conventional prior art air break disconnecting switches. The jaw contacts which are generally U-shaped are of the reverse loop type. Generally straight contact shoes are mounted on the jaw contact housing forming the reverse loop contact with a minimum gap, to develop the maximum magnetic force and a very high contact pressure during fault conditions. The contact shoes are provided with backup springs, which are partially electrically isolated, biasing the shoes together and providing contact pressure during normal operation for wiping clean dirt and corrosion on the contact surfaces. The contact shoes are joined together at one end for better lineup and mounting simplicity. That is, when more than one contact shoe is used on one side of the jaw contact they are formed integral at the end which is joined to the contact jaw.

An insulating bumper is located inside of the jaw contact between the contact shoes to keep them spaced apart when the switch is in the open position and to act as a stop for the switchblade when the switch is closed.

The bumper is located at the inner bight portion of the U-shaped reverse loop jaw contact. The pivoting terminal contacts, mounted on the stationary insulators, do not use any flexible wire or braid connectors. The pivot arms are attached to pivot pins which permit pivoting movement. The pivots are formed from electrically conducting material with straight contact shoes and backup springs mounted on each end of the pivot pins to provide high pressure continuous electrical contact between the pivoting member and the stationary portions of the terminal. An insulating low friction Nyliner is used for the bearing surfaces of the pivot pins. The current path is thus through the ends of the pivot pins. The electrical circuit connections are made to stationary terminal pads. Pivot stops are supported on the pivotal portion of the terminal contact. The stops are made from a high impact strength insulating material and are used to define the swing of the contact bar.

A spring loaded latch is provided for locking each contact bar in the open position. The latch is operated by the jaw contact on the switchblade during a closing sequence and by the pivoting contact as well as the biasing spring during an opening operation. When the contact bar is moved to a closed position, the switchblade is deflected slightly and goes to an over toggle position. This tends to keep the switchblade closed. The entrance clearance of the jaw contact around the contact bar and the blade deflection are related and depend on the length of the pivot arms and the angle of swing of the contact bar. The operating effort for the air break disconnect switch is determined by the length and size of the blade, the width of the contact bar, the contact pressure, the coefficient of friction, the length of the pivot arms that support the contact bar, and the angle of swing. These various parameters can be altered to change the required operating effort.

It is an object of this invention to teach a double break air disconnecting switch wherein only the center insulator rotates and the switchblade is securely connected thereto for unitary movement therewith.

It is an object of this invention to teach a double break air disconnecting switch wherein the switchblade is supported from a rotatable insulator and has jaw contacts connected to the ends thereof for engaging a contact bar which is movably supported by pivot arms from the end stationary insulators.

BRIEF DESCRIPTION OF THE DRAWINGS

For a better understanding of the invention reference may be had to the preferred embodiments exemplary of the invention shown in the accompanying drawings, in which.

DESCRIPTION OF THE PREFERRED EMBODIMENTS

Figure 1:
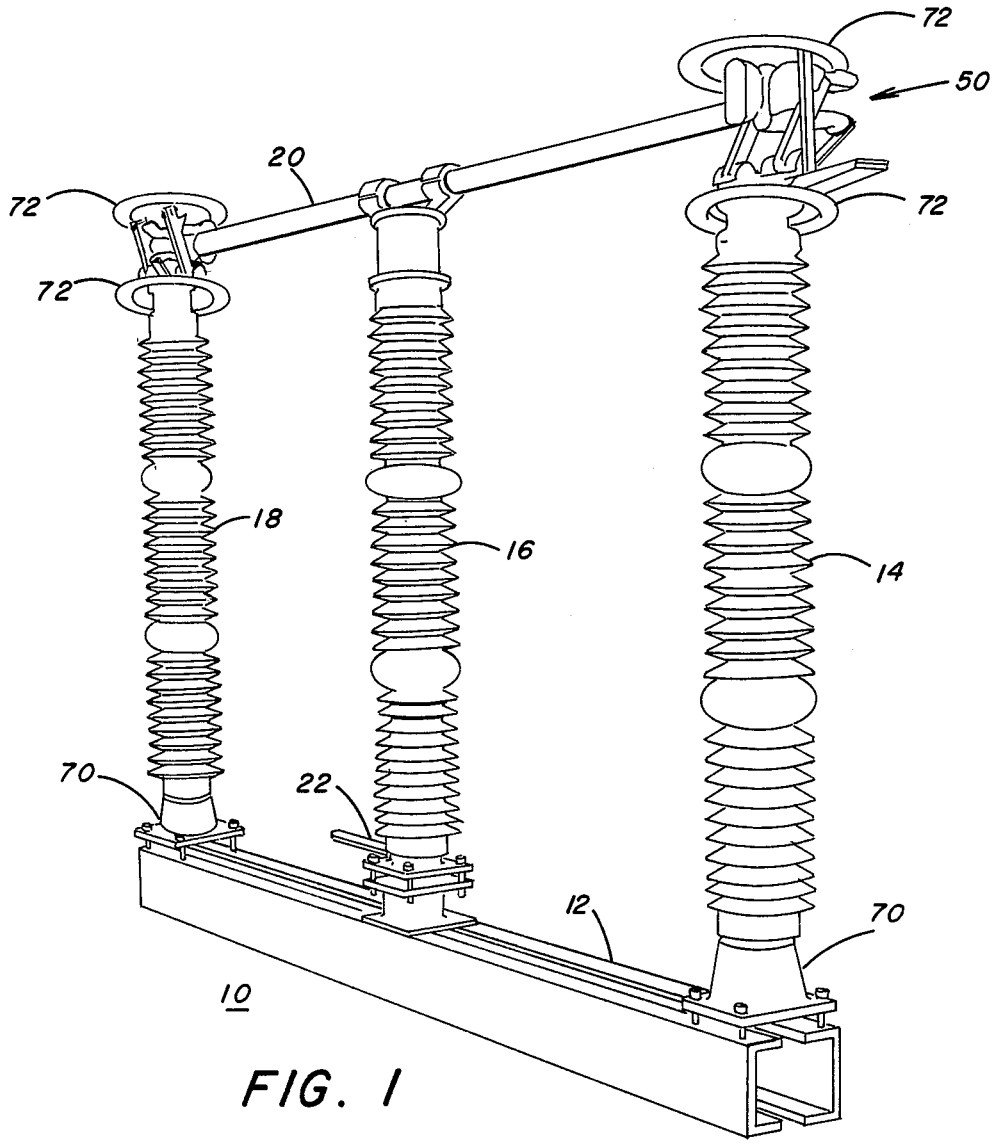
FIG. 1 is a perspective view of a double side air break disconnecting switch utilizing the teaching of the present invention.
Figure 2:
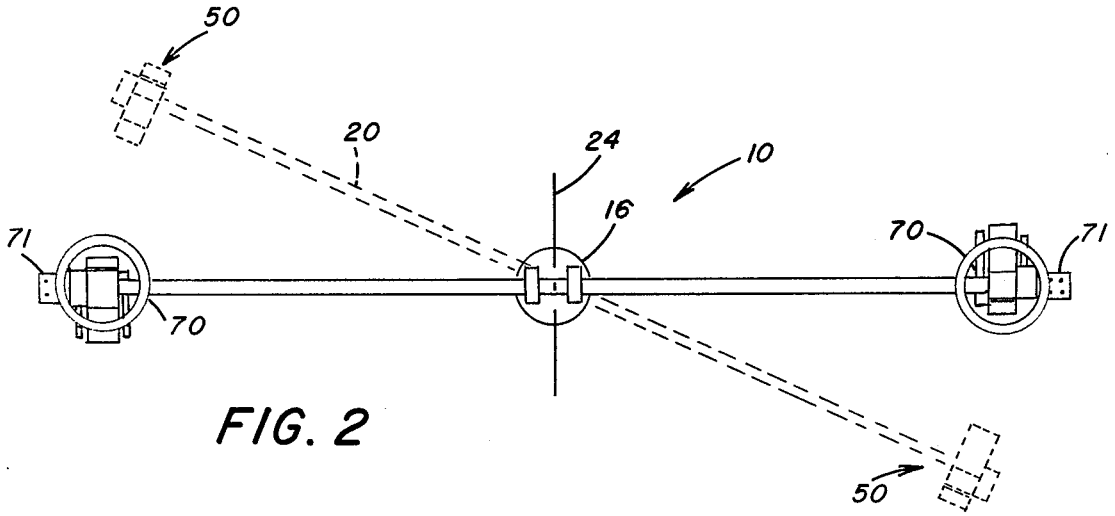
FIG. 2 is a top view of the air disconnect switch shown in FIG. 1.
Figure 3:
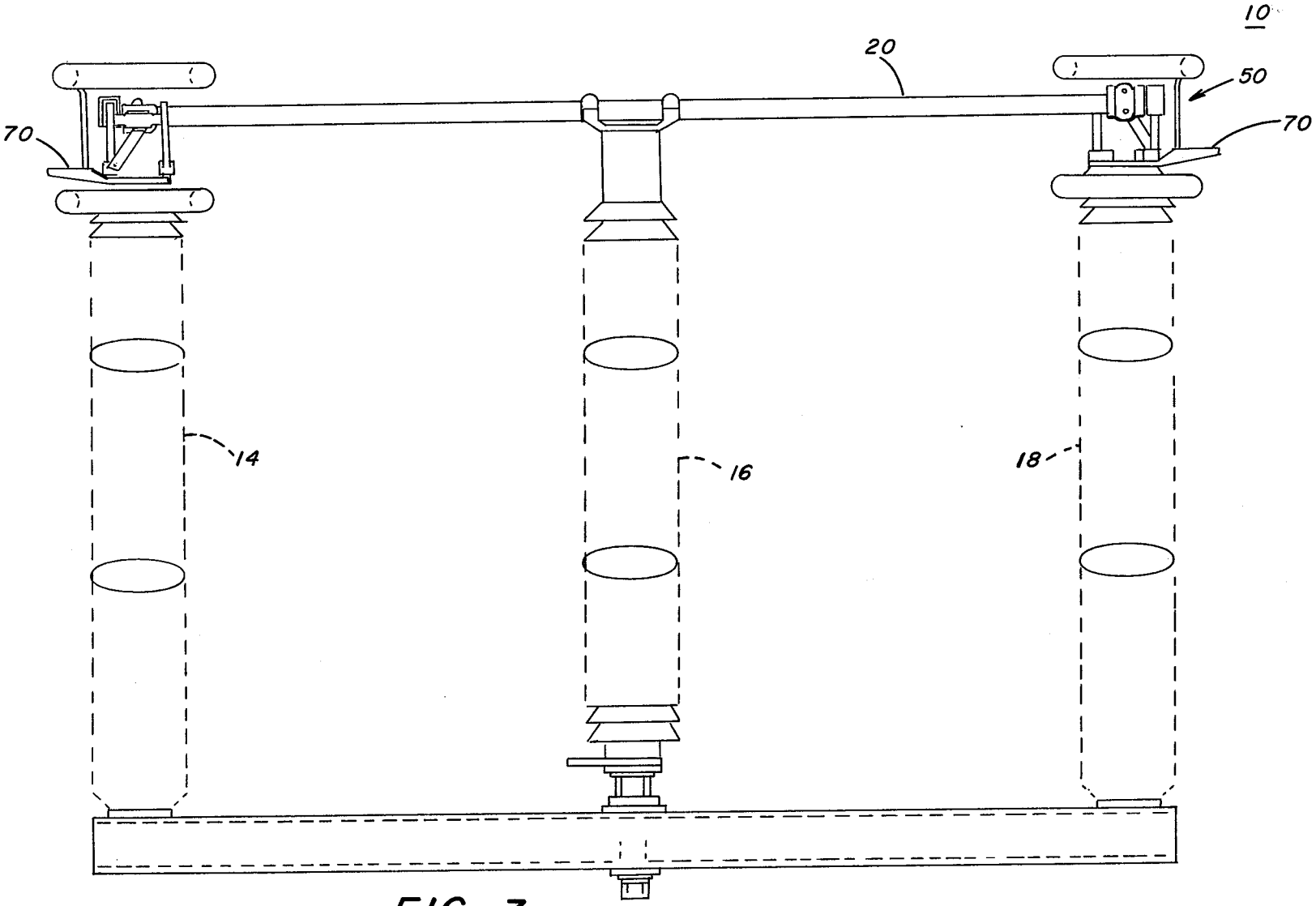
FIG. 3 is a side view of the double break air disconnect switch shown in FIG. 1.
Figure 4:
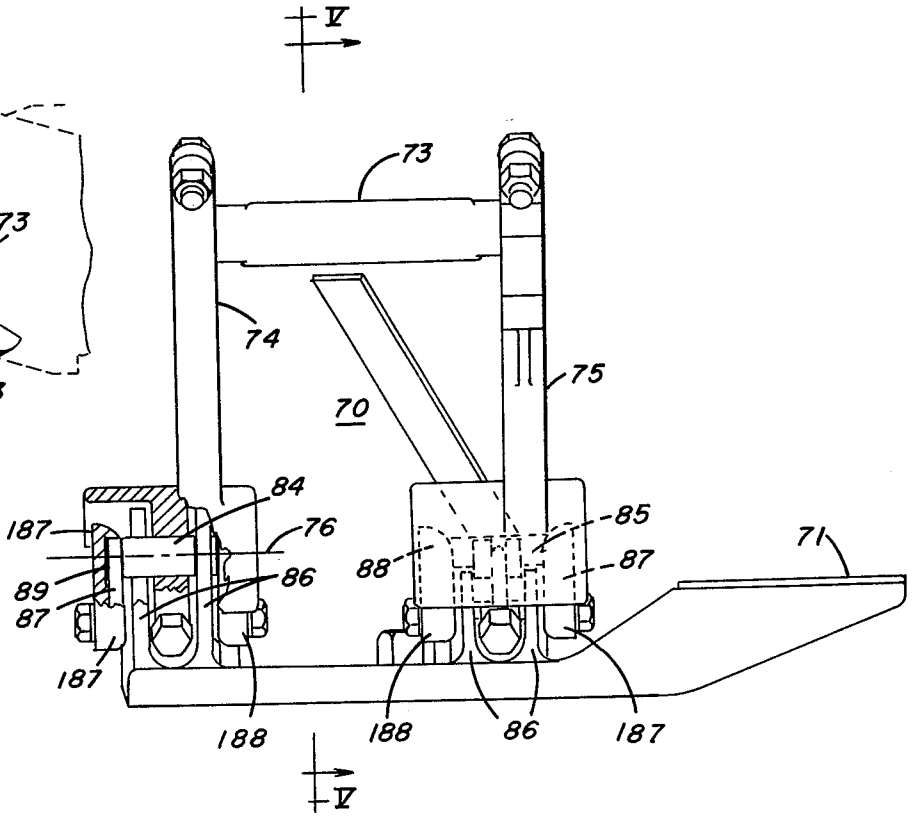
FIG. 4 is an enlarged front view partially in section of a terminal assembly.
Figure 5:
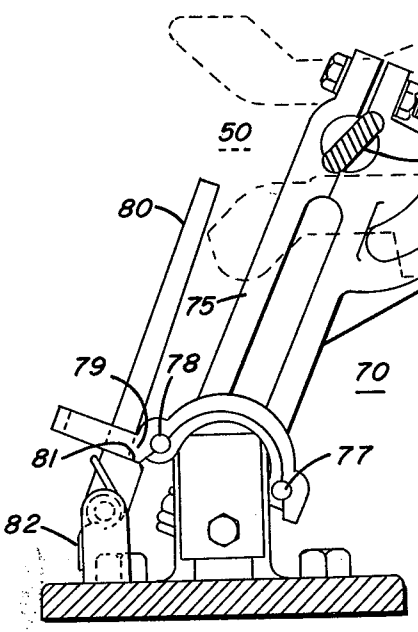
FIG. 5 is a view of the terminal assembly shown in FIG. 4 along the line V—V with a portion of the jaw contact shown in phantom.

Referring now to the drawings and FIGS. 1 through 3 in particular there is shown a double side air break disconnecting switch utilizing the teaching of the present invention. Double side air break disconnect switch 10 is constructed with a structural support base 12 from which three vertical insulators 14, 16 and 18 extend. Center insulator 16 has an electrically conducting switchblade 20 securely connected to its free ends.

Switchblade 20 is a tubular member formed from a material having good electrical conducting properties such as aluminum. Insulators 14 and 18 are rigidly connected to base 12 and cannot move with respect thereto. Center insulator 16 is supported for rotational movement about its longitudinal axis. An operating lever 22 is provided at the base of rotatable insulator 16 for rotating insulator 16. Switchblade 20 is securely fastened to insulator 16 for unitary movement therewith. Unitary movement as used in the specification and claims means that switchblade 20 and insulator 16 move as an integral or one piece unit. That is, when insulator 16 moves switchblade 20 moves as a unit therewith and there is no relative movement, other than a small deflection of switchblade 20, between insulator 16 and switchblade 20. When the term no relative movement is used in this specification and claims, with respect to insulator 20 and switchblade 16, it means that they are rigidly connected at their point of connection and the only movement of one of these items with respect to the other is small deflections. As insulator 16 is rotated, switchblade 20 also rotates about a common axis. The common axis is the longitudinal axis of insulator 16. Insulator 16 is rotatable between a closed position as shown in FIGS. 1 and 2 and an open position wherein switchblade 20 is positioned along line 24 in FIG. 2, which is approximately at 90° with repsect to the longitudinal axis of the structural support base 12. When used on a three phase system, three air disconnect switches 10 can be used, one for each phase. The switches are spaced far enough apart so that when the switchblades are in the open position there is adequate clearance between the open blades. A jaw type contact 50 is attached to each free end of switchblade 20. When switch 10 is closed, jaw contacts 50 engage terminal assemblies 70 supported on each stationary insulator 14 and 18. Terminal connection pad 71 is provided on each terminal assembly for connecting switch 10 to the electrical conductors in the circuit to be controlled. Corona shielding 72 is provided above each terminal assembly 70 to reduce electrical stress when the switch is energized and to prevent corona discharge. For certain high voltage switches, such as those operated at 345KU corona shielding 72 can also be provided beneath terminal assembly 70. When disconnect switch 10 is in the closed position a continuous electrical conducting path exists from terminal assembly 70 mounted on insulator 18 through contact jaw 50, switchblade 20, contact jaw 50, to terminal assembly 70 mounted on insulator 14.

Figure 6:
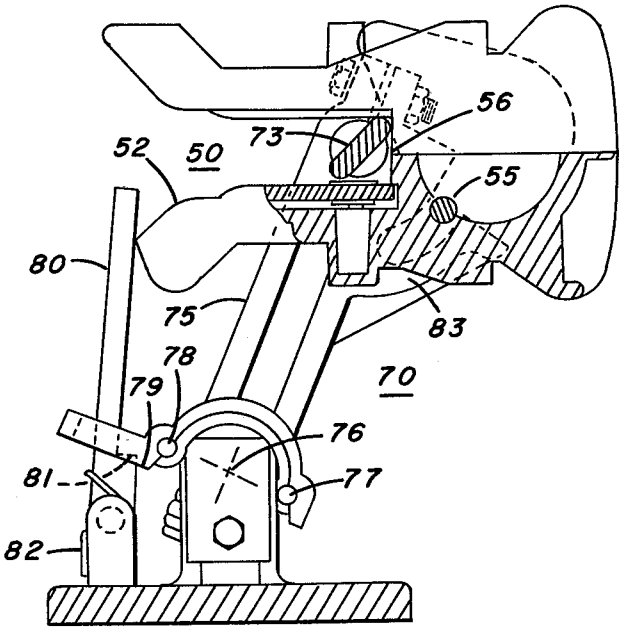
FIG. 6 is a view similar to FIG. 5, but showing the jaw contact fully disposed around the contact bar and releasing the latch assembly.
Figure 9:
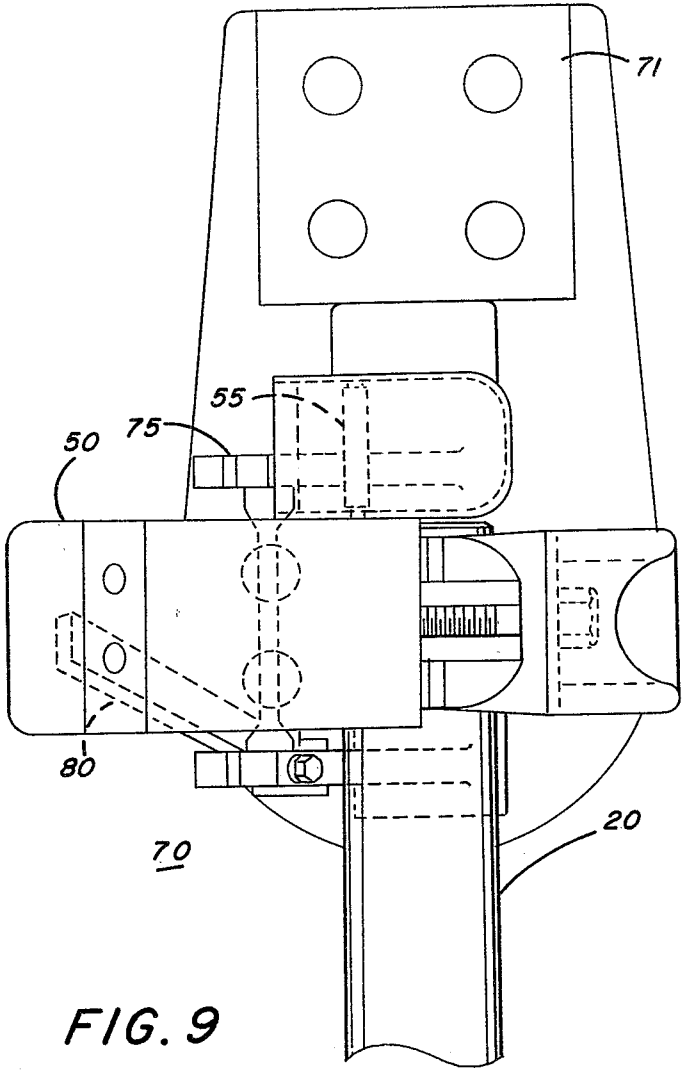
FIG. 9 is a top view of the portion of the switch shown in FIG. 8.

Referring now to FIGS. 4 through 8 there is shown a detailed view of terminal assembly 70. Terminal assembly 70 includes a contact bar 73 which is engaged by jaw contact 50 when switch 10 is closed. Contact bar 73 is supported between a pair of conducting pivot arms 74 and 75. Pivot arms 74 and 75 are supported for pivotal movement about an axis 76. Pivot arms 74 and 75 have pivot pins 84 formed integral therewith. Contact pivot arms 74 and 75 are pivotal between an open position wherein the width axis of contact bar 73 extends at an angle of approximately 45° with respect to the vertical, as best seen in FIG. 6, and a closed position wherein the width axis of contact bar 73 extends in a vertical direction as can best be seen in FIG. 8. Stops 77 and 78 are provided to limit travel of support pivot arms 74 and 75. Pivot arms 74, 75 carry contact bar 73 between the free ends thereof. As can best be seen in FIG. 5 when contact bar 73 is in the open position, stop 77 contacts a stationary portion of terminal 70 to limit clockwise travel. Likewise when contact bar 73 is in the full closed position, shown in FIG. 8, stop 78 contacts a stationary portion of terminal 70 to limit counterclockwise travel. During closing of switch 10, jaw contact 50 fits around contact bar 73. As contact bar 73 is moved to the closed position, it is rotated with respect to contact 50 moving into high pressure engagement with jaw contact 50 to establish good electrical contact. A locking member 80 is provided for holding contact bar 73 in the open position until jaw contact 50 is fully inserted thereon. When jaw contact 50 is fully inserted around contact bar 73, a portion of jaw contact 50 engages lock 80 moving latching surface 81 to an unlatched position permitting pivot arms 74 and 75 to pivot about axis 76. Latching surface 81 when in the latched position is engaged by a portion 79 of pivot arm 75. Torsion spring 82 is provided for biasing lock 80 to a latched position. Thus as switch 10 is opened, contact bar 73 moves to the open position where surface 81 engages the surface on portion 79.

Pivot arms 75 are provided with a hook portion 83 which is engaged by a roller supported on jaw contact 50 when switch 10 is closed. When switch 10 moves to the open position roller sleeve 55, formed on the outside of jaw contact 50, engages hook portion 83 to positively move pivot arm 75 and the associated contact bar 73 to the open position. Contact bar 73 is thus moved to the open position independent of its engagement with jaw contact 50. There are thus two forces moving contact bar 73 to the open position when switch 10 is opened. As contact jaw 50 moves to the open position its engagement with contact bar 73 tends to pull contact bar 73 to the open position. At the same time, sleeve roller 55 is in engagement with hook 83 and also moves pivot arm 75 and the associated contact bar 73 to the open position. In the embodiment as shown sleeve 55 is fixed, it is to be understood however, that sleeve 55 can be movable about one end to engage the hook 83 when jaw contact 50 is forced against contact bar 73. This embodiment, with the sleeve 55 movable, can be useful when the contact bar 73 is accidently moved from the open position without the jaw contact 50 having first engaged the contact bar 73. For example, sleeve 55 might be pivotable about where it connects to contact 50.

Terminal contact 70 does not utilize flexible electrical conductors or braids for making the electrical connection between contact bar 73 and terminal pad 71. Contact arm 74 has formed integral therewith cylindrical bearing member 84. Likewise, pivot arm 75 is formed with a conducting cylindrical bearing support 85. Bearing members 84 and 85 ride on low friction sleeves or liners which are usually formed of an insulating material. Bearing members 84 and 85 are supported on low friction flanged Nyliners by projections 86 from the bottom stationary portion of terminal 70. A sliding electrical connection is maintained between bearing cylinders 84, 85 and end shoes 87 and 88 used on each. These shoes 87 and 88 are bolted to terminal 70 and are spring baised to make sliding electrical contact with the ends of cylindrical portions 84, 85. Backup members or spring containers 187 and 188 are used to secure members 87 and 88, respectively, in position. Belleville spring washers 89 are provided between members 87, 88 and the associated members 187, 188. There are thus numerous sliding electrical paths between the movable contact bars 73 and the rigid terminal connector plate 71. The straight contact shoes with backup springs 89 mounted on each end provide high pressure continuous contact between the portion and the stationary portion of terminal 70.

Figure 10:
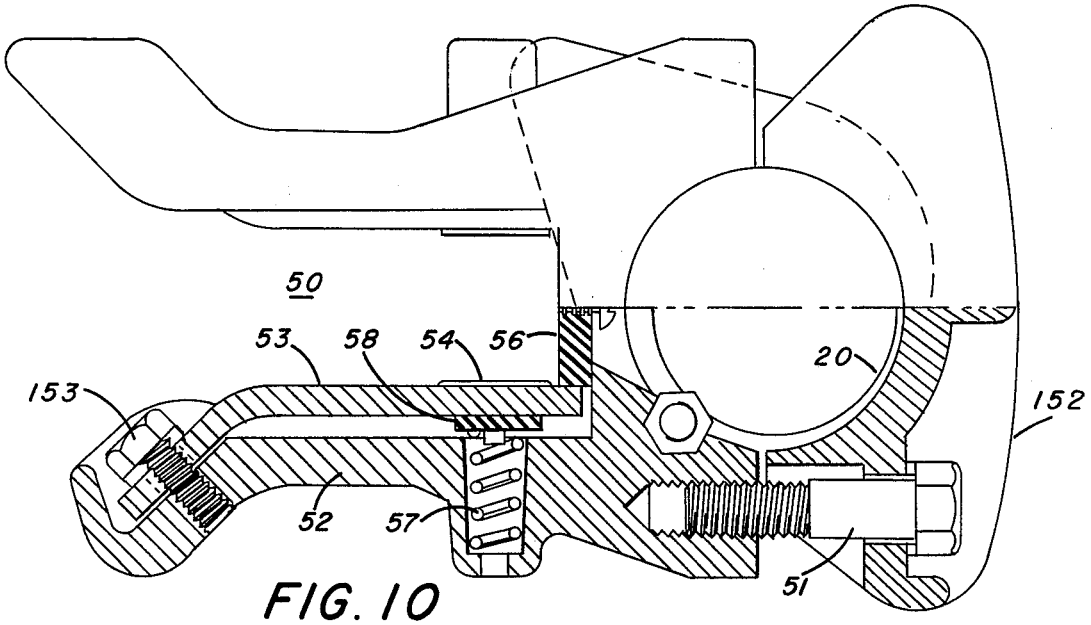
FIG. 10 is an outside end view of the jaw contact partially in section.
Figure 11:
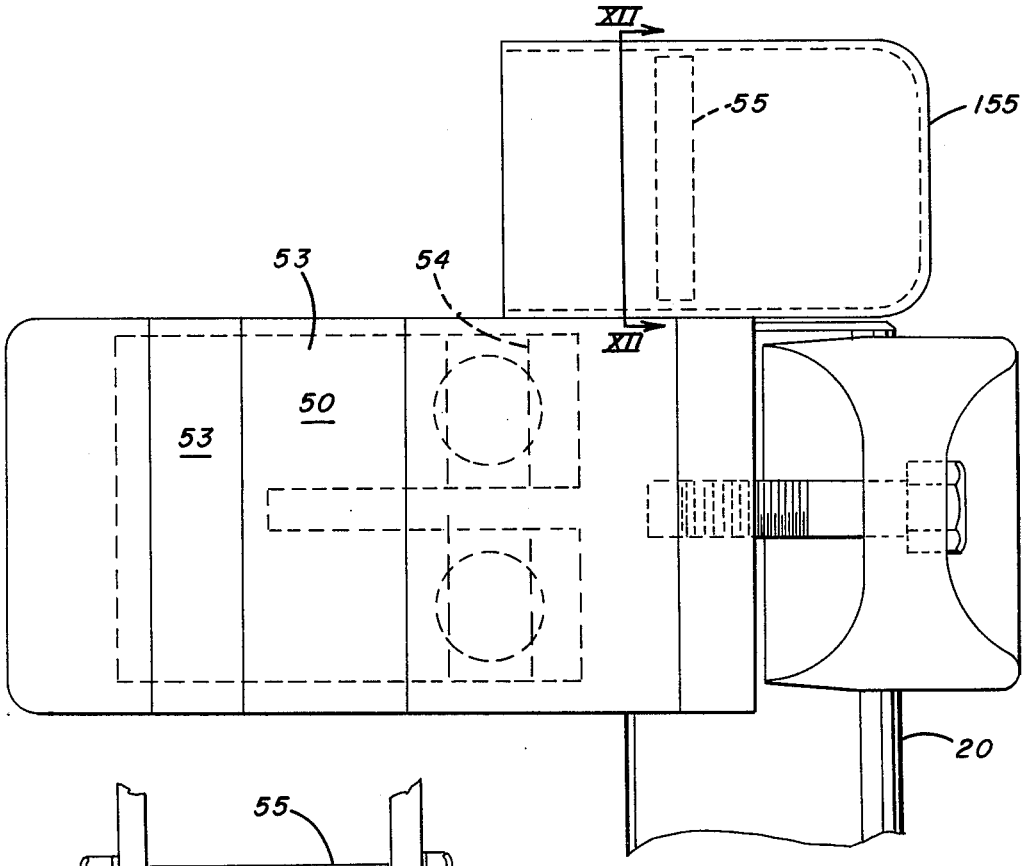
FIG. 11 is a top view of the jaw contact.
Figure 12:
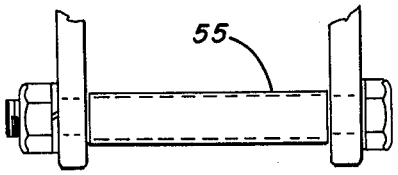
FIG. 12 is a view of a portion of the jaw contact of FIG. 11 along the line XII—XII showing the roller sleeve which engages one of the pivot arms.

Referring now to FIGS. 10 and 11 there is shown a detailed view of jaw contact 50. Jaw contact 50 is of the reverse loop type having the characteristic of magnetically increasing contact pressure on contact bar 73 in response to momentary high current. A jaw contact 50 is attached to each end of switchblade 20. Jaw contact 50 includes various clamping bolts 51 which are tightened to pull sections 52 and 152 together and securely clamp contact 50 to tubular switchblade 20. Jaw contact 50 consists of a portion or housing 52 which is of a generally U-shape. Contact shoes 53 having a straight portion are connected near the outer ends of U-shaped housing 52 by bolts 153 and extend in a reentrant direction. Contact pads 54, formed of a good electrical contact material, are positioned near the inner ends of the straight shoes 53. An inner bumper 56 formed of an insulating material is disposed within the U-shaped housing near the bight portion. Biasing springs 57 are connected between the straight portion of contact shoes 53 and housing 52 to urge the portions of contact shoes 53 towards each other and in contact conatct with the insulating barrier 56. Insulating barrier 56 provides for proper spacing of contact shoes 53. An insulating spacer 58 is provided on the backside of contact shoes 53 for engaging spring 57 so that a conducting path is not provided from contact shoe 53 through spring 57 to housing 52. The backup springs 57 are electrically isolated to provide contact pressure at normal operation for wiping clean dirt and corrosion from the contact surfaces 54. When contact bar 73 is vertically aligned between contact pads 54, high pressure contact is provided therebetween.

Jaw contact 50 also includes a roller sleeve housing 155 extending therefrom. A roller sleeve 55 is disposed within extending portion 155. Roller sleeve 55 engages a slot 83 formed on pivot arm 75. This positively positions contact bar 73 to the open position when switch 10 is opened. Sleeve 55 can be made movable if desired. Bumper 56 serves not only as an insulating spacer between contact shoes 53 but also as a stop for contact bar 73 as switch 10 is closed.

The disclosed construction wherein the jaw contact 50 is mounted on the ends of switchblade 20 is the exact opposite of most conventional, presently produced double side air break disconnect switches. This construction provides for maximum protection from ice and corona. Mechanical advantage for relative positioning of the contact bar 73 is achieved by the pivot motion of the support arms 74 and 75 mounted on stationary insulators 14 and 18. The mechanical advantage can be changed by varying the length of the pivot support arms 74 and 75. The switchblade 20 is fully controlled and it rotates with the center insulator at no speed limitations. The switchblade 20 will not twist or rotate about its longitudinal axis.

Figure 7:
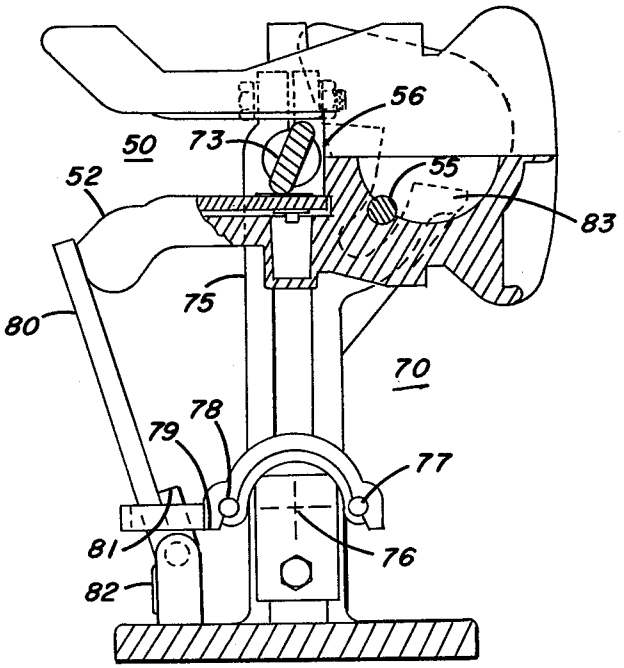
FIG. 7 is a view similar to FIG. 6, but with the switch moved further towards the closed position and the pivot arms vertical.
Figure 8:
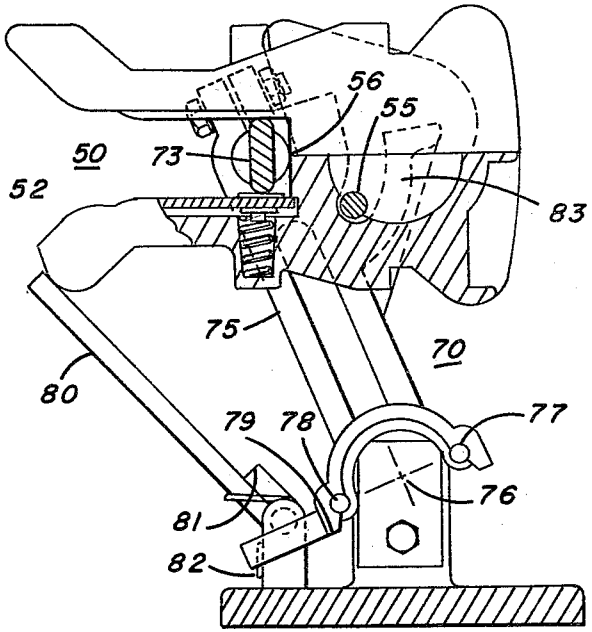
FIG. 8 is similar to FIG. 7 but showing the contact bar moved to the fully closed position with its width axis vertical.

By rotating center insulator 16 in the proper direction the blade 20 will move and the contact jaws 50 are positioned to surround contact bar 73. When contact bar 73 is far enough into jaw 50, latch arm 80 is moved by jaw housing portion 52 releasing pivot arm 75. As the insulator 16 is continued to rotate, the longitudinal axis of contact bar 73 starts to move about axis 76. As the bar swings about axis 76 it will twist around its longitudinal axis with respect to contact jaw 50. As contact bar 73 pivots it spreads contact shoes 53 providing high contact pressure between contact pads 54 and contact bar 73. This high pressure engagement is provided while a relatively low torque is required to rotate the center rotatable insulator 16. At the same time as contact bar 73 is rotated, the roller 55 mounted from jaw contact 50 will go into the hook portion 83 of pivot arm 75. As contact bar 73 moves from the open to closed position, switchblade 20 is forced to deflect slightly and pass a toggle condition. This can best be appreciated from FIGS. 5 through 7 which are scaled drawings to the same scale. As switch 10 moves to the position shown in FIG. 7, the ends of switchblade 20 are deflected upward with respect to its fixed connection to insulator 16. This is caused since when pivot arms 74, 75 are vertical, the longitudinal axis of switch contact bar 73 is at greatest spacing with respect to the top of the fixed insulator 14 or 18. During closing as the switchblade moves past this toggle position as shown in FIG. 7 the spring force stored in deflected switchblade 20 helps move to and maintain the switch at a fully closed position as shown in FIG. 8.

The switch 10 is fully closed when the stops 78 on the pivot arms 74 and 75 engages the fixed portion of terminal assembly 70. At this time switchblade 20 is at an overtoggle condition forcing the stop 78 to the closed position.

Rotating the center insulator 16 in the clockwise direction as viewed in FIG. 2 will pull the contact bar 73 out of its closed position by means of the hook 83 and roller sleeve 55 and also by the engagement between jaw contact 50 and contact bar 73. As switch 10 opens, the contact bar 73 will swing about its pivot axis 76 moving about its longitudinal axis with respect to jaw contact 50 and releasing the contact pressure. This again requires low torque applied on the center insulator 16. At the same time the spring loaded latch 80 will move to the locking position to lock the pivot arms 74 and 75 in the open position. During this opening operation, contact bar 73 again goes through a curved trajectory forcing the switchblade 20 to deflect slightly and pass toggle condition.

The disclosed double break air disconnect switch 10 has numerous advantages over various prior art switches. Switchblade 20 is fixed to the center rotating insulator 16. This simplifies attachment as well as making the switchblade 20 fully controllable at all times through positioning of insulator 16. Pivoting motion of the contact bar 73 mounted from the stationary insulators 14 and 18 insure mechanical advantage during the closing and opening engagements, and thus minimizes operating torque required to operate the switch. Mounting the jaw contacts 50 on each end of the switchblade 20, which is the exact opposite of the commercial conventional double side air break switches, provides easy contact adjustment, assembly simplification and maximum protection against ice and corona. Relatively straight contact shoes 53 which are mounted on the jaw contact housing 52 provide a reverse loop with a minimum air gap, generating maximum magnetic force to develop a high contact pressure during fault conditions. The contact springs which are electrically isolated from direct contact with shoes 52 provide high contact pressure under normal operating conditions for wiping clean dirt and corrosion. The contact bar 73 is locked in the open position, but a spring loaded latch 80 disengages when the bar is far enough into the contact jaw and the contact bar 73 is free to rotate and establish contact pressure. Premature rotating of the contact bar relative to the jaw contact which can be a problem in some prior art switches, is thus eliminated. Hook 83 and roller 55 are positive mechanical means of pulling the pivot contact into a locked open position. When moving to the open or closed position, the switchblade is forced to pass toggle conditions and this assists in moving the contact bar 73 in either the open or closed positions.

What is claimed is:

1. A double side air break disconnecting switch comprising:

a base formed from an elongated structural support;

a first insulator, which is stationary, connected in proximity to one end of said base;

a second insulator, which is stationary, connected in proximity to the other end of said base;

a third insulator, supported for rotary movement around its longitudinal axis from said base intermediate said first and second insulators;

an elongated blade rigidly secured intermediate its ends to said third insulator for unitary movement therewith;

a pair of jaw contacts, one being connected to each end of said elongated blade and each defining a bifurcated portion; and, a pair of contact bars, one supported on said first insulator and the other supported on said second insulator disposed to be engaged by said pair of jaw contacts when said third insulator is moved to a closed position completing an electric circuit through the disconnecting switch.

2. A double side air break disconnecting switch as claimed in claim 1 wherein each of said jaw contacts comprises:

a generally U-shaped contact support;

a pair of contact shoes each attached to a free end of said U-shaped contact support and extending inside of said U-shaped contact support to form a reverse loop contact; and, an insulating bumper disposed between said pair of contact shoes in proximity to the bight portion of said U-shaped contact support.

3. A double side air break disconnecting switch as claimed in claim 2 wherein said jaw contact further comprises:

spring biasing means disposed between each of said pair of contact shoes and said U-shaped contact support to bias said pair of contact shoes toward each other into engagement with said insulating bumper disposed therebetween; and, insulating means for electrically insulating said spring biasing means to prevent an electrically conducting path through said spring biasing means from said contact shoe to said U-shaped contact support.

4. A double side air break disconnecting switch as claimed in claim 1 comprising:

pivot support means for supporting each contact bar for pivotal movement of its longitudinal axis about a spaced apart fixed axis; and, said pivotal support means and said elongated switch blade disposed so when the switch is closed the engaged switch blade and the associated contact bar move to an overtoggle position aiding in maintaining the switch in the closed position.

5. A double side air break disconnecting switch comprising, a base formed from an elongated structural support;

a first insulator, which is stationary, connected in proximity to one end of said base;

a second insulator, which is stationary, connected in proximity to the other end of said base;

a third insulator, supported for rotary movement from said base intermediate said first and second insulators;

an elongated blade rigidly secured intermediate its ends to said third insulator for unitary movement therewith;

a pair of jaw contacts, one being connected to each of said elongated blade and each defining a bifurcated portion;

a pair of contact bars, one supported on said first insulator and the other supported on said second insulator disposed to be engaged by said pair of jaw contacts when said third insulator is moved to a closed position completing an electric circuit through the disconnecting switch;

a pair of terminal assemblies, one supporting each of said contact bars; and, each of said terminal assemblies comprises:

a pair of spaced apart pivot arms having one set of ends pivotal about a fixed axis and having said contact bar disposed between the other set of ends;

said pair of spaced pivot arms being pivotable between an open position and a closed position, wherein said contact bar is in high pressure engagement with the bifurcated portion of the associated jaw contact;

a latch for locking said pair of spaced apart pivot arms in the open position; and, latch release means operated by said jaw contact for releasing said latch when said jaw contact is fully disposed around said associated contact bar.

6. A double side air break disconnecting switch as claimed in claim 5 comprising:

a hook portion formed on one of said pair of spaced apart pivot arms; and, said associated contact jaw comprises a sleeve portion formed for engaging said hook portion when the switch is closed, adapted to positively move said pair of spaced apart pivot arms to the open position when the switch is opened.

7. A double side air break disconnecting switch as claimed in claim 5 wherein:

said latch is movable between a latched position engaging a portion of said pair of pivot arms and an unlatched position not engaging said pair of pivot arms; and comprising, a spring biasing said latch to the latched position.

8. A double side air break disconnecting switch as claimed in claim 5 wherein:

each of said pivot arms are formed with a cylindrical bearing portion extending along the axis about which said pivot arms are pivotable; and, pivot contacts being spring loaded and making electrical contact with the ends of the cylindrical bearing portions.

9. A double side air break disconnecting switch as claimed in claim 5 comprising:

a closed stop to limit travel of said pivot arms at a selected closed position; and, an open stop to limit travel of said pivot arms in the other direction at a selected open position.

10. A high voltage electric switch comprising:

an elongated stationary insulator;

an elongated rotatable insulator, spaced apart from said stationary insulator, rotatable around its longitudinal axis between a closed position and an open position;

a contact terminal which comprises a contact bar supported on said stationary insulator;

an elongated switchblade rigidly connected to said rotatable insulator for unitary movement therewith having at least one free end;

said switchblade is connected to said elongated rotatable insulator so there is no relative movement therebetween; and, a jaw contact secured to the free end of said elongated blade having a bifurcated portion which fits on and makes electrical contact with the contact bar of said contact terminal when said rotatable insulator is rotated around its longitudinal axis to the closed position and which is spaced apart from said contact terminal when said rotatable insulator is in the open position.

11. A high voltage electric switch comprising, a stationary insulator;

a rotatable insulator, spaced apart from said stationary insulator, rotatable between a closed position and an open position;

a contact terminal which comprises a contact bar supported on said stationary insulator;

an elongated switchblade securely connected to said rotatable insulator for unitary movement therewith having at least one free end;

a jaw contact secured to the free end of said elongated blade having a bifurcated portion which fits on and makes electrical contact with the contact bar on said contact terminal when said rotatable insulator is rotated to the closed position and which is spaced apart from said contact terminal when said rotatable insulator is in the open position; and wherein said contact terminal further comprises:

a pair of spaced apart pivot arms having said contact bar disposed between one end thereof and the other end being pivotable around a fixed axis;

said pivot arms being movable between an open position, with said contact bar not in high pressure engagement with said jaw contact and a closed position, with said contact bar in high pressure engagement with said jaw contact; and, a latch for locking said pair of spaced apart pivot arms, between which said contact bar is supported in the open position until said jaw contact is fully inserted around said contact bar.

12. A high voltage electric switch as claimed in claim 11 comprising:

positioning means formed on said jaw contact and on said contact terminal for positively positioning said contact bar to the open position when said rotatable insulator is moved from the closed position to the open position independent of the engagement of said jaw contact with said contact bar.

13. A high voltage electric switch as claimed in claim 12 wherein said jaw contact comprises:

an outer member comprising two leg portions connected by a bight section;

a pair of reentrant contact members extending from the free end of the leg portions toward the bight portion; and, an insulating separator disposed between the free ends of the reentrant contact portions.

14. A high voltage electric switch as claimed in claim 13 comprising:

spring biasing means disposed between each leg portion and the associated reentrant contact portion but not providing an electrical path therebetween.

15. A high voltage electric switch comprising:

a first vertically disposed high voltage insulator;

a second vertically disposed high voltage insulator spaced apart from said first vertically disposed high voltage insulator, supported for rotary movement around its vertical axis;

an elongated electrically conductive switchblade connected to said second vertically disposed high voltage insulator, for unitary movement therewith and for no relative movement therebetween, supported for arcuate movement in a horizontal plane only;

a contact bar, which is elongated and supported from said first high voltage insulator with its longitudinal axis in a horizontal position; and, a jaw contact, having a bifurcated portion which engages said contact bar when the high voltage switch is closed, secured to the end of said elongated electrically conductive switchblade.

16. A high voltage electric switch as claimed in claim 15 comprising:

pivot support means supporting said contact bar from said first high voltage insulator for arcuate movement of the longitudinal axis of said contact bar about a fixed axis between an open position and a closed position; and, said contact bar having a greater width than thickness and being disposed when in the open position with the width axes and the thickness axes extending transverse to the longitudinal axes of the bifurcations and when in the closed position having the width axes normal to the longitudinal axes of the bifurcations and the thickness axes parallel to the longitudinal axes of the bifurcations to provide high pressure engagement between the contact bar and said jaw contact.

17. A high voltage electric switch as claimed in claim 16 comprising:

locking means for locking said pivot support means in the open position until the jaw contact is inserted with the contact bar fully within the bifurcated portion.

18. A high voltage electric switch as claimed in claim 17 comprising:

lock release means activated by said jaw contact when fully disposed around said contact bar to release said locking means permitting said contact bar to move to the closed position.

19. A high voltage electric switch as claimed in claim 18 comprising:

an electrically conducting bearing supporting said contact bar for movement while providing an electrical conductive path therethrough.

20. A high voltage electric switch as claimed in claim 18 comprising:

a roller sleeve connected to said jaw contact; and, a hook connected to said pivot support means engaged by said roller sleeve when said contact bar is moved to the closed position for positively positioning said contact bar when the switch is moved from the closed position to the open position.

21. A high voltage electric switch as claimed in claim 15 wherein said jaw contact comprises a reverse loop contact comprising:

an insulating bumper disposed between the free inward projecting ends of the reverse loop contact; and, spring biasing means for biasing the inward projecting portions of the reverse loop contact together against said insulating bumper.

22. An electric switch comprising:

an elongated base;

a pair of stationary insulators supported at opposite ends of said base;

a rotatable insulator supported on said base between said pair of stationary insulators for rotary movement around an axis generally perpendicular to said base;

an elongated switchblade rigidly secured intermediate its ends to said rotatable insulator for unitary movement therewith;

a pair of contact bars, one attached to each of said pair of stationary insulators;

a pair of jaw contacts, each having a pronged portion, one connected to each end of said elongated switchblade; and, means for rotating said rotatable insulator between a closed position, wherein the jaw contacts at each end of said elongated switchblade engage one of said pair of contact bars with the prongs disposed around the engaged contact bar, and an open position, wherein said jaw contacts at each end of said elongated switchblade are spaced apart from said contact bars.

23. An electric switch as claimed in claim 22 comprising:

pivot support means associated with each one of said pair of contact bars for supporting the associated contact bar for arcuate movement of its longitudinal axes about a fixed axes between a disengaged position and an engaged position; and, said contact bar formed such that when said pivot means is in the disengaged position said contact bar does not make high pressure engagement with the pronged portion and when said pivot means is in the engaged position, said contact bar is moved relative to said jaw contacts to provide high pressure engagement with the pronged portion of said jaw contact.

24. An electric switch as claimed in claim 23 wherein:

said pivot means moves only in response to movement of said jaw contact;

lock means for holding said pivot means in the disengaged position until said jaw contact is fully inserted on said contact bar; and, lock release means operable in response to the positioning of said jaw contact for releasing said lock means when said jaw contact is fully disposed around said contact bar.

25. An electric switch as claimed in claim 22 wherein said jaw contact comprises:

a reentrant portion to define a reverse loop contact;

biasing spring means disposed between the reentrant portion and the outer portion of said jaw contact to bias the reentrant portions of said jaw contact toward each other; and, an insulated stopper means disposed between said reentrant contact portions to limit relative movement.

26. An electric switch comprising:

a terminal contact assembly;

a jaw contact assembly, comprising two separated jaw members with a bight portion extending therebetween, movable between a closed position, engaging and forming electrical contact with said terminal contact assembly, and an open position, separated from said terminal contact assembly; and, said terminal contact assembly comprises:

a contact bar;

a pair of pivot arms, spaced apart and having one pair of ends pivotal about an axis and said contact bar disposed between the other pair of ends, pivotal between a first position, disengaged from high pressure engagement with said jaw contact assembly, and a second position in high pressure engagement with said jaw contact assembly; and, latch means connected to said pair of pivot arms for latching them in the first position until said contact bar is fully disposed in said jaw contact assembly in proximity to the bight portion.

27. An electric switch as claimed in claim 26 comprising:

latch release means operable by said jaw contact for releasing said latch means when said jaw contact assembly moves to a selected position.

28. A contact assembly for an electric apparatus comprising:

an elongated contact bar;

support means for supporting said elongated contact bar for arcuate movement of its longitudinal axes about a fixed axes;

a U-shaped movable contact having two leg portions connected by a bight portion movable between an open position, separated from said elongated contact bar, and a closed position, engaging said contact bar;

said elongated contact bar movable by said U-shaped contact between a first position, not in high pressure engagement with said U-shaped contact, and a second position, in high pressure engagement with the legs of said U-shaped contact;

latch means for latching said elongated contact bar in the first position; and, latch release means operable by said U-shaped contact for releasing said latch means when said elongated contact is fully within said U-shaped contact in proximity to the bight portion.

* * * * *